US010453423B2

(12) United States Patent
Nasiriavanaki et al.

(10) Patent No.: US 10,453,423 B2
(45) **Date of Patent: *Oct. 22, 2019**

(54) PERCEPTUALLY OPTIMISED COLOR CALIBRATION METHOD AND SYSTEM

(71) Applicant: BARCO N.V., Kortrijk (BE)

(72) Inventors: Alireza Nasiriavanaki, Portland, OR (US); Johan Pierre Rostang, Marcq-en-Baroeul (FR); Cédric Fabrice Marchessoux, Halluin (FR)

(73) Assignee: BARCO N.V., Kortrijk (BE)

( * ) Notice: Subject to any disclaimer, the term of this patent is extended or adjusted under 35 U.S.C. 154(b) by 69 days.

This patent is subject to a terminal disclaimer.

(21) Appl. No.: 15/709,712

(22) Filed: Sep. 20, 2017

(65) Prior Publication Data

US 2018/0033396 A1 Feb. 1, 2018

Related U.S. Application Data

(62) Division of application No. 14/491,250, filed on Sep. 19, 2014, now Pat. No. 9,799,305.

(51) Int. Cl.
*G09G 5/02* (2006.01)
*G09G 5/06* (2006.01)

(52) U.S. Cl.
CPC ..... *G09G 5/026* (2013.01); *G09G 5/06* (2013.01); *G09G 2320/0666* (2013.01);
(Continued)

(58) Field of Classification Search
None
See application file for complete search history.

(56) References Cited

U.S. PATENT DOCUMENTS 7,466,447 B2 12/2008 Stokes et al.
8,384,722 B1 2/2013 Tremblay et al.
(Continued)

FOREIGN PATENT DOCUMENTS

EP 1 047 263 A1 10/2000
WO 2013/025688 2/2013

OTHER PUBLICATIONS

Lissner, Ingmar, and Philipp Urban. "Toward a unified color space for perception-based image processing." IEEE Transactions on Image Processing 21.3 (2012): 1153-1168. (Year: 2012).*
(Continued)

*Primary Examiner* — Vu Nguyen
(74) *Attorney, Agent, or Firm* — Renner, Otto, Boisselle & Sklar, LLP

(57) ABSTRACT

Methods, devices, controllers and systems for color calibration of displays, non-volatile (non-transient) memory, controllers, display devices or display systems including a color calibration transform, operation of such controllers, display devices or systems and software for color calibration of a display are described are described that make use of a color transform having a distribution of color points across a full display gamut (hence optionally preserving full contrast and color saturation in the calibrated display) in an at least substantially perceptually uniform manner suitable for use as a color display calibration adapted for medical applications. A perceptually uniform spread of color points can be in terms of a distance metric such as deltaE2000 for color or JND for gray.

15 Claims, 15 Drawing Sheets

(52) U.S. Cl.
CPC ..... *G09G 2320/0673* (2013.01); *G09G 2320/0693* (2013.01); *G09G 2340/06* (2013.01); *G09G 2380/08* (2013.01)

(56) References Cited

U.S. PATENT DOCUMENTS

2002/0039104 A1 4/2002 Sato et al.
2005/0128499 A1 6/2005 Glickman
2007/0167754 A1 7/2007 Okuno et al.
2007/0222730 A1 9/2007 Kao
2008/0123918 A1 5/2008 Saotome et al.
2010/0086230 A1 4/2010 Bala
2010/0220048 A1 9/2010 Yamamura
2011/0164051 A1* 7/2011 Marcu ..... G09G 5/363 345/604
2011/0175552 A1* 7/2011 Kwon ..... G09G 3/3406 315/307
2012/0013635 A1* 1/2012 Beeman ..... G09G 3/2003 345/590
2013/0187958 A1 7/2013 Kimpe
2013/0286040 A1* 10/2013 Kawaguchi ..... H04N 1/60 345/601
2014/0210802 A1* 7/2014 Myers ..... G09G 3/3413 345/207
2015/0160839 A1 6/2015 Krishnaswamy

OTHER PUBLICATIONS

Lissner et al.; "Toward a unified color space for perception-based image processing." IEEE Transactions on Image Processing 21.3 (2012): 1153-1168.
Partial International Search Report for corresponding International Patent Application No. PCT/EP2016/050313 dated Apr. 14, 2016.
International Search Report for corresponding International Patent Application No. PCT/EP2016/050313 dated Jul. 7, 2016.
Office Action dated Aug. 27, 2018 in related U.S. Appl. No. 15/553,109.

* cited by examiner $$\Delta E = \sqrt{\left(\frac{\Delta L'}{K_L S_L}\right)^2 + \left(\frac{\Delta C'}{K_C S_C}\right)^2 + \left(\frac{\Delta H'}{K_H S_H}\right)^2 + R_C\left(\frac{\Delta C'}{K_C S_C}\right)\left(\frac{\Delta H'}{K_H S_H}\right)}$$

$$\bar{L}' = (L_1 + L_2)/2$$

$$C_1 = \sqrt{a_1^2 + b_1^2}$$

$$C_2 = \sqrt{a_2^2 + b_2^2}$$

$$\bar{C} = (C_1 + C_2)/2$$

$$G = \left(1 - \sqrt{\frac{\bar{C}^7}{\bar{C}^7 + 25^7}}\right)\Big/2$$

$$a_1' = a_1(1+G)$$

$$a_2' = a_2(1+G)$$

$$C_1' = \sqrt{a_1'^2 + b_1^2}$$

$$C_2' = \sqrt{a_2'^2 + b_2^2}$$

$$\bar{C}' = (C_1' + C_2')/2$$

$$\Delta L' = L_2 - L_1$$

$$\Delta C' = C_2' - C_1'$$

$$\Delta H' = 2\sqrt{C_1' C_2'}\sin(\Delta h'/2)$$

$$S_L = 1 + \frac{0.015(\bar{L}' - 50)^2}{\sqrt{20 + (\bar{L}' - 50)^2}}$$

$$S_C = 1 + 0.045\bar{C}'$$

$$S_H = 1 + 0.015\bar{C}'T$$

$$\Delta\theta = 30\exp\left\{-\left(\frac{\bar{H}' - 275°}{25}\right)^2\right\}$$

$$R_C = 2\sqrt{\frac{\bar{C}'^7}{\bar{C}'^7 + 25^7}}$$

$$R_T = -R_C\sin(2\Delta\theta)$$

$$h_1' = \begin{cases} \tan^{-1}(b_1/a_1') & \tan^{-1}(b_1/a_1') \geq 0 \\ \tan^{-1}(b_1/a_1') + 360° & \tan^{-1}(b_1/a_1') < 0 \end{cases}$$

$$h_2' = \begin{cases} \tan^{-1}(b_2/a_2') & \tan^{-1}(b_2/a_2') \geq 0 \\ \tan^{-1}(b_2/a_2') + 360° & \tan^{-1}(b_2/a_2') < 0 \end{cases}$$

$$\bar{H}' = \begin{cases} (h_1' + h_2' + 360°)/2 & |h_1' - h_2'| > 180° \\ (h_1' + h_2')/2 & |h_1' - h_2'| \leq 180° \end{cases}$$

$$\Delta h' = \begin{cases} h_2' - h_1' & |h_2' - h_1'| \leq 180° \\ h_2' - h_1' + 360° & |h_2' - h_1'| > 180°; h_2' \leq h_1' \\ h_2' - h_1' - 360° & |h_2' - h_1'| > 180°; h_2' > h_1' \end{cases}$$

$$K_L = 1 \quad \text{default}$$

$$K_C = 1 \quad \text{default}$$

$$K_H = 1 \quad \text{default}$$

$$T = 1 - 0.17\cos(\bar{H}' - 30°) + 0.24\cos(2\bar{H}') + 0.32\cos(3\bar{H}' + 6°) - 0.20\cos(4\bar{H}' - 63°)$$

FIG. 2

$$D = \sum d_i$$

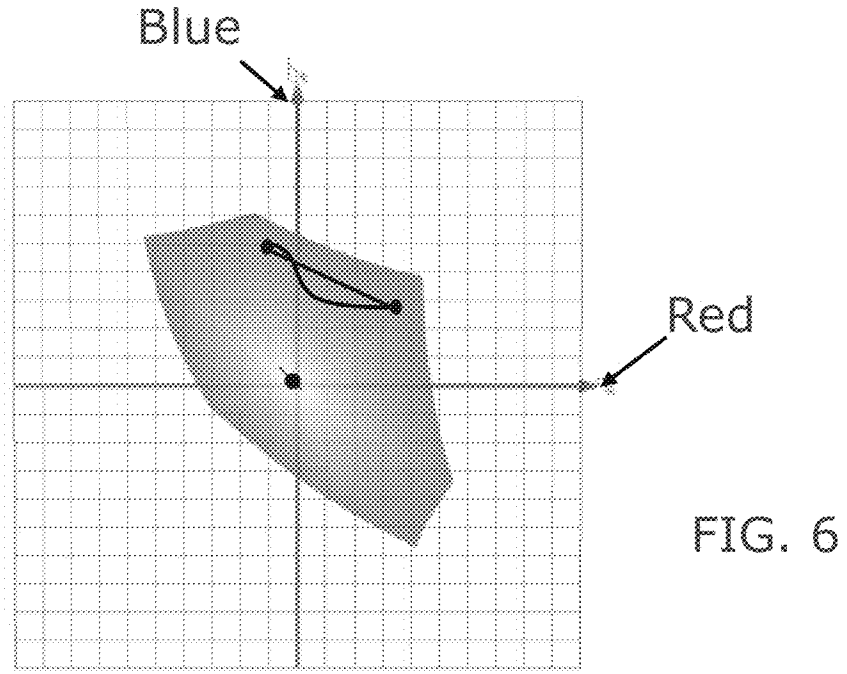
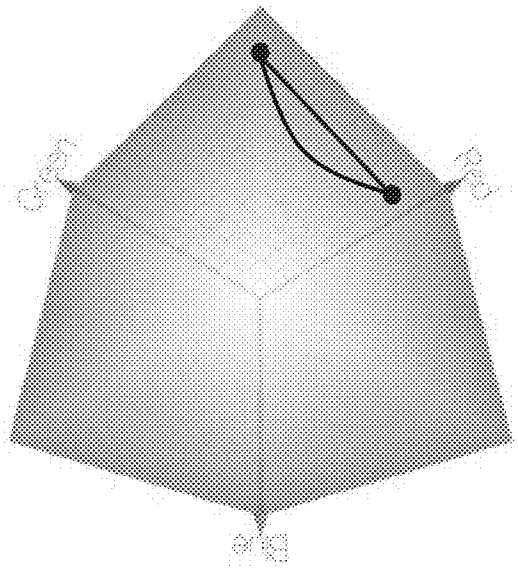
FIG. 6

$$P = \frac{P_1 * d_{23} + P_2 * d_{13} + P_3 * d_{12}}{d_{23} + d_{13} + d_{12}}$$

PERCEPTUALLY OPTIMISED COLOR CALIBRATION METHOD AND SYSTEM

This application is a divisional of U.S. Nonprovisional patent application Ser. No. 14/491,250 filed Sep. 19, 2014, which is hereby incorporated herein by reference.

FIELD OF THE INVENTION

The present invention relates to methods, devices, controllers and systems for color calibration of displays, to non-volatile (non-transient) memory, controllers, display devices or display systems including a color calibration transform, to operation of such controllers, display devices or systems and to software for color calibration of a display.

SOME BACKGROUND

Grayscale medical imaging, such as X-ray images, has been standardized for many years. The Grayscale Standard Display Function (GSDF) defined by NEMA in 1998 describes exactly the transfer curve for a medical grayscale display function. The result of applying this function on the image and the display is a perceptually linear representation of the grayscale image. This brings for this field of medical imaging the great benefit that the visibility of medical features is uniform over the complete range of digital driving levels (DDL). When the grayscale image is not represented in a perceptually linear way, errors may occur. For example, a chest nodule could appear or disappear completely because its grayscale value is just some DDL's too high or too low, resulting in a difference with its surroundings that is below the threshold of visibility. This kind of error is not acceptable for medical imaging. The perceived threshold or Just Noticeable Difference (JND) is derived from Barten's work on the Contrast Sensitivity Function (Barten, 1992).

In recent years medical imaging is evolving more and more from pure grayscale images to color images. Until now, color medical imaging has not been standardized, although the situation with colored images case is a bit more complex. Depending on the specific field of medicine, there may be other requirements for the representation of colors. For surgery and examination using for instance endoscopes, an exact representation of colors is a prerequisite. The endoscope combined with the display can be considered as an extension of the doctor's eyes and hence should present an image that is the same as would be provided to the doctor. The same can be held for the interpretation of wound photographs used in tele-medicine, where the color is giving an indication if a wound is healing.

The situation is different for the emerging markets of digital pathology or quantitative imaging. For this kind of images it is of great importance, similar to the situation depicted for grayscale images, that the doctor is able to discover relevant medical features in the images. To facilitate the discovery it is important to visualize especially the differences between the features and the background of the image. Hence distinguishability can be more important than a perfectly truthful image.

In a conventional digital image processing chain for pathology, the display is conventionally not considered as an essential part to optimize the detectability of the features in the scanned slides. The approach so far is to represent the colors in exactly the same way as how the pathologist would perceive them when looking through the microscope. To obtain this, the scanned slide is for instance saved in the sRGB color space and the display is assumed to be sRGB calibrated. In the best case ICC profiles can be used to take into account the gamut of the actual display or a specific calibration method is applied to guarantee accurate color reproduction, see for example "WO2013025688 SYSTEM AND APPARATUS FOR THE CALIBRATION AND MANAGEMENT OF COLOR IN MICROSCOPE SLIDES".

This approach has some flaws. First of all, what is the "correct" color? The colors that are perceived when using a microscope depend on the spectrum of the light source of the microscope. Thus, a slide will look different from microscope to microscope or from set up to set up. In addition, hospitals or laboratories often have their own procedures for preparing slides and to perform the staining. Although more or less the same procedure is used in different labs, the intensity of the staining can vary significantly. To make the situation even more complex, after scanning the slides the colors can differ even more depending on the scanner used. Different scanners with the same illumination can produce images with different colors. Therefore it is not advisable to rely on the exact representation of colors for digital pathology applications.

In quantitative medical imaging, the results of calculations are visualized using pseudo colors on top of other medical images or as images on their own. Because these colors are calculated, it is possible to define a color space in which the image is rendered, for instance sRGB, and by using a display and the correct ICC profiles, the calculated colors can be quite accurately visualized.

However, in such images often there is only a small amount of the scale that is represented by one primary color such as red, whereas another primary color such as green can represent the biggest range of the quantitative values, making it difficult to distinguish the colors in this scale. Using a perceptually linear color scale can help optimize the visualization of the quantitative colors and reveal potentially hidden details in the image. This can only be realized when taking into account the gamut of the display used for the visualization of the image. In both digital pathology and quantitative imaging it is critical to optimally visualize the differences between the features and the background. Therefore, with a similar reasoning one can conclude that digital pathology images may be better interpreted on a perceptually linear color display.

Calibrating a display in such a way that it is perceived as being linear may involve using a perceptually uniform color space. One such color space is proposed in "*Toward a Unified Color Space for Perception-Based Image Processing*", Ingmar Lissner and Philipp Urban, IEEE Transactions on Image Processing, (Volume: 21, Issue: 3), 04 August 2011 ISSN:1057-7149. Their "perceptually uniform" and "hue linear" color space is called $LAB2000_{HL}$ (including variations optimized for color difference metrics other than $\Delta E_{2000}$) and is derived from CIELAB and $\Delta E_{2000}$. In this paper reference to "perceptually uniform" means that $\Delta E_{2000}$ within $LAB2000_{HL}$ is a only Euclidean distance locally and it is shown that it is impossible to design a color space in which $\Delta E_{2000}$ is a true Euclidean distance other than locally. The paper discloses iterative adjustment of the color grid points on equi-luminance planes, while enforcing some other constraints including hue-linearity, which causes some loss in perceptual uniformity.

Another perceptually linear color space contender, UP Lab (http://www.brucelindbloom.com/UPLab.html) does a better job for sRGB blue primary but has problems for green and red. Without being limited by theory, these problems may be due to the fact that both UP Lab and $LAB2000_{HL}$ separate luminance and chrominance at the outset while there is evidence in the literature that the two may not be treated separately in constructing a perceptually uniform color space.

For a color display calibration suited for medical applications, there is a need to find a method of distributing color points across a full display gamut in a perceptually uniform manner while preserving full contrast and color saturation in the calibrated display and without the problems mentioned above with the prior art methods.

SUMMARY OF THE INVENTION

An advantage of embodiments of the present is the distribution of color points across a full display gamut (hence optionally preserving full contrast and color saturation in the calibrated display) in an at least substantially perceptually uniform manner. Embodiments of the present invention are less affected by at least one of the problems mentioned above with respect to the prior art. Such embodiments are suitable for use as a color display calibration suited for medical applications. A perceptually uniform manner can be in terms of a distance metric such as deltaE2000 for color or JND for gray.

Embodiments of the present invention provide a color calibration method comprising the steps:

express a set of color points defining a gamut in a first color space;

map said set of color points from the first color space to a second color space;

redistribute the mapped set of color points in the second color space wherein the redistributed set has improved perceptional linearity while substantially preserving color gamut of the set of points, and map the redistributed set of color points from the second color space to a third color space.

The result of this method is a color calibration transform which can be stored in a non-volatile LUT memory.

An improved perceptional linearity can be obtained by:

a) Partitioning the first color space gamut using volume filling geometric structures such as polyhedrons, e.g. tetrahedrons;

b) Redistributing color points on the edges of each polyhedron to obtain improved perceptual linearity on the edges of each polyhedron;

Redistributing the color points on the faces of each polyhedron to obtain improved perceptual linearity on the faces by replacing each color point by an interpolated value obtained based on redistributed surrounding points on edges of the polyhedron that form the boundaries of that face of the polyhedron.

Redistributing the color points inside each polyhedron to obtain improved perceptual linearity by replacing each such color point by an interpolated value obtained based on redistributed surrounding faces of the polyhedron containing the inside color point.

The above method perceptually linearizes edges, faces and interior of the polyhedrons.

In another aspect improved perceptional linearity can be obtained by:

a) Partitioning the second color space gamut using using volume filling geometric structures such as polyhedrons, e.g. tetrahedrons;

b) Redistributing the color points on edges of each polyhedron to obtain improved perceptual linearity on the edges of each polyhedron;

Redistributing the color points on the faces of each polyhedron to obtain improved linearity of the Euclidean distances between color points on the faces by replacing each color point by an interpolated value obtained based on the redistributed surrounding points on edges of the polyhedron that form the boundaries of that face of the polyhedron;

Redistributing color points inside each polyhedron to obtain improved linearity of the Euclidean distances between color points inside each polyhedron by replacing each color point by an interpolated value obtained based on the redistributed surrounding faces of the polyhedron containing the inside color point.

The above method perceptually linearizes the edges, then the faces of the tetrahedrons in the second color space while the interior of the tetrahedrons is linearized in the first color space such as an RGB color space in which distance between color points are Euclidean distances.

In another aspect, embodiments of the present invention provide a color calibration method comprising the steps:

expressing a set of color points defining a gamut in a first color space mapping said set of color points from the first color space to a second color space linearizing the mapped set of points in the second color space by making the color points in the second color space perceptually equidistant in terms of one or more color difference metrics throughout the color space, and mapping the linearized set of points from the second color space to a third color space or back to the first color space, to calculate a calibration transform.

With respect to any of the above mentioned embodiments, each color point can be expressed with a number of co-ordinates, e.g. three coordinates in each color space but the present invention is not limited thereto. For example, it can be used with color points having four or more co-ordinates. The coordinates in the second color space are preferably a function of the coordinates of the color points in the first color space. The third color space can be the same as the first color space. The third color space may have a greater bit depth than the first color space.

Any of the methods above can include the step that the set of points in the first color space are measured. In any of the methods above, the color points can be made evenly distributed perceptually by:

dividing the second color space using a plurality of geometrical structures, e.g. polyhedrons such as tetrahedrons which are gamut volume filling;

performing perceptual color point linearizing procedure on the edges, the sides and inside of each tetrahedron and averaging color values derived from the tetrahedrons. The averaging can involve various interpolations between linearized color points. The interpolations are preferably between the faces of the gamut volume and the gray line.

Perceptual linearization involves making color points that are spaced equally or substantially equally in terms of a color difference metric such as the deltaE2000, or with respect to gray points a metric such as JND, . . . The relevant color space may be selected, for example from native RGB, sRGB, CIE Lab, CIE XYZ, . . . etc.

Embodiments of the present invention conserve the full gamut or substantially the full gamut of the display device by populating the color space starting from outer boundaries of the gamut and working inwards. The calibrated space can be constructed in a way that the color points have improved perceptional linearity, e.g. are equidistant in terms of a color distance metric such as the deltaE2000 while keeping the original shape of the gamut intact or substantially intact.

A color space has a grey line which joins color points having only a gray value which typically will vary from black to white along the gray line. Embodiments of the present invention can conserve the DICOM grey scale e.g. by determining color points by constructing a plurality of geometrical figures that are gamut volume filling to aid in this determining step. The geometric structures can be formed from polyhedrons such as tetrahedrons that share the grey line. Optionally an additional smoothing can be performed to further increase image quality.

Other features of any of the methods above can include any of or any combination of: setting gray points in the calibrated space having improved perceptional linearity, e.g. equidistant in terms of JND, ensuring DICOM GSDF compliance for gray and/or creating a smooth transition between gray (e.g. JND-uniform or "perceptually linear") and color (e.g. ΔE2000-uniform) behaviors.

The method may also include the steps of achieving color points with improved perceptional linearity, e.g. equidistant color points (e.g. as defined by the color distance deltaE2000) on gamut edges and then interpolating on gamut faces and from there to within the gamut volume. A color distance such as the deltaE2000 distance is not a Euclidean distance in a color space. Hence, the color difference measured by $deltaE_{2000}$ is only valid locally, i.e. between closely adjacent points.

In another aspect embodiments of the present invention provide a display device or system configured to linearize a color space by the method as described above and in more detail in the description of the illustrative embodiments below. The color calibration method can be used with a display device, for example the calibration transform explained above can be stored in a non-volatile 3D LUT memory in the memory. The color calibration method can also be used with a display system, for example the calibration transform can be stored in a non-volatile 3D LUT memory in the system. For example the non-volatile 3D LUT memory can be in a display controller or associated with a GPU, e.g. in a controller, or in a pixel shader. The color calibration transform can for example be stored in a non-volatile 3D LUT memory.

Embodiments of the present invention provide a color calibration transform stored in a non-volatile LUT memory for a display device, the display device having a native gamut defined in a color space, the calibration transform having a set of calibrated color points derived from the gamut; wherein the calibrated set has improved perceptional linearity compared with the native gamut while substantially preserving a color gamut of the set of points.

Some embodiments of the present invention provide a display device and a method of calibrating and operating such a display device conform with a DICOM calibration based on taking a set of points in a first (input) color scale such as RGB, mapping it to a second perceptually linear color space and then mapping it to a third output color space which can be the same as the input space, e.g. that RGB, wherein color points are equidistance in all of the three dimensions.

In a method of calibrating and operating a display device, an implementation and use of the full gamut of the display device and the grey diagonal is described. An advantage of embodiments of the present invention is that a perceptually linear color space is populated with color points in three dimensions. Embodiments of the present invention additionally comply with the DICOM grey scale calibration (GSDF), which is often a requirement for medical applications. A further advantage is the provision of a visualization method and system able to optimize the complete chain for medical color images, including dealing with the complexity of characterizing and calibrating the visualization system. A further advantage is the provision of a visualization system or method having a known and predictable behavior.

A further advantage is the provision of a visualization system or method available that is optimized to detect features in medical color images, such as digital pathology slides and quantitative medical images. Further the visualization system and method can be made compliant with DICOM GSDF so that the end user does not have to change the visualization system or method or even to adapt the mode of the visualization system or method to examine grayscale images. Finally, the visualization system or method itself can take care of correctly calibrating colors.

Methods, systems and devices according to embodiments of the present invention optimize the visualization of color images such as medical color images by creating a perceptually uniform color space that makes use of the full available gamut to improve visibility of differences between the background and features instead of relying on color reproduction.

Methods, systems and devices according to embodiments of the present invention create a hybrid system that are DICOM GSDF compliant, perceptually uniform or can combine DICOM GSDF compliancy with a perceptually uniform color space, using a combination of a 3D LUT and 3× 1D LUT.

BRIEF DESCRIPTION OF THE FIGURES

FIG. 2 illustrates how to calculate deltaE2000.

FIG. 6 illustrates that a straight line in the first color space such as an RGB space is curved in the perceptually linear or uniform color space e.g. CIELAB space.

DEFINITIONS

Figure 1:
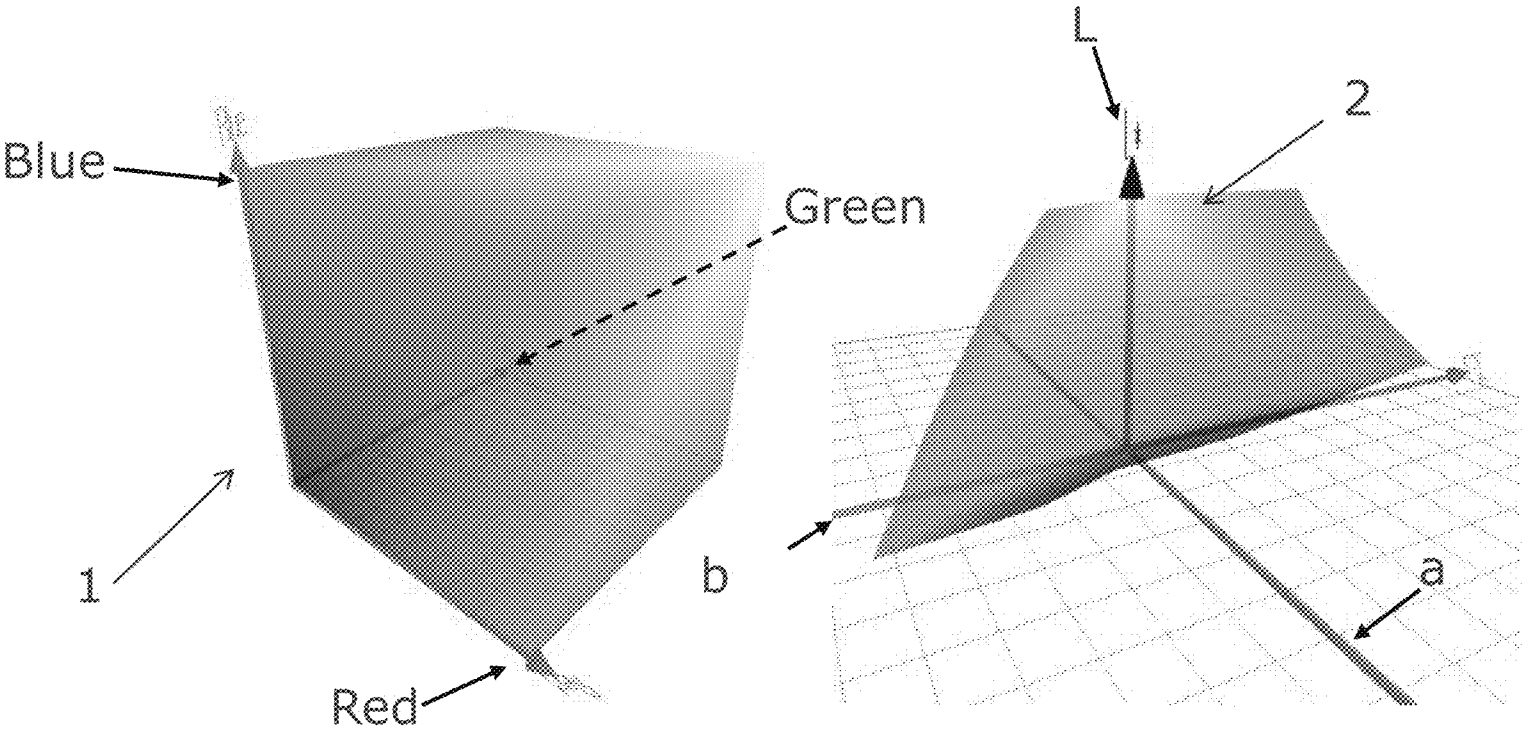
FIG. 1 shows a gamut in an RGB space and the same gamut mapped into CIELAB space.

"Display or display device or display unit or display system" relates to a device or system that can generate an image, e.g. a full color image. A display for example may be a back projection display or a direct view display. The display may also be a computer screen or visual display unit or a printed image. A printed image may differ from other displays because it relies on color subtraction whereas other displays rely on color addition.

"Color space". Images are typically stored in a particular color space, e.g. CIE XYZ; CIELUV; CIELAB; CIEUVW; sRGB; Adobe RGB; Adobe Wide Gamut RGB; YIQ, YUV, YDbDr; YPbPr, YCbCr; xvYCC; CMYK; raw RGB color triplets; . . . ). CIE-L*a*b*, CIE 1976 (Lab) and CIELAB, are different denominations of the same color space.

Some reference documents for Standards:

CIELAB: MCLAREN K. The development of the CIE 1976 (1*a*b*) uniform colour-space and color difference formula. Journal of the Society of Dyers and Colourists, vol. 92, pp. 338-341,1976. DOI: 10.1111/j.1478-4408.1976.tb03301.x DeltaE2000 (or CIEDE2000): CIE Publication No. 142. Improvement to Industrial Colour-Difference Evaluation. Tech. rep., Central Bureau of the CIE, Vienna, 2001. This document is incorporated herein by reference. A draft of this document is available here: http://cie.mogi.bme.hu/cie_arch/kee/div1/tc147.pdf This document is incorporated herein by reference. A draft of this document is available here: ftp://medical.nema.org/medical/dicom/final/sup28_ft.pdf "Input or output color space" In order to describe colors, color spaces are known that are defined based on different principles. For example, there is the RGB color space which describes an additive color system, the HSV color space based on saturation, hue and intensity (value) properties of color, the CMYK color space, which describes a subtractive color system. A digital image file may be received with colors defined by one color space which is then called the input color space. The output color space is the color space based on which the color of an image point in the displayed image is determined. The output color space can be, but does not have to be, the same as the initial color space.

"Perceptually linear space" or "Perceptually uniform color space". A perceptually linear space or a perceptually uniform color space is to be understood as any space for color representation in which the three-dimensional distances between the colors substantially correspond to the color difference that can be perceived by a typical human observer. Hence, in a perceptually linear color space a color difference corresponds to the psychophysical perceived color difference. For example, the CIELab space is based on a mathematical transformation of the CIE standard color space. Such color spaces are described by various names which include CIELUV, the CIE 1976 (Luv), the CIE 1976 (Lab) or the CIELAB color space, for example. Such color spaces can describe all the colors which can be perceived by the human eye. In case of perceptually linear display systems, equal distances in the input signal will also result in equal perceptual color distances. Such a perceptual color difference can be defined by a variety of standards, e.g. by deltaE76, deltaE94, deltaE2000, DICOM GSDF JND, etc. of the visualized output.

"Transforming color spaces". There are various models for transforming color spaces into perceived color spaces, in which the color difference corresponds to the perceived color difference.

"Color coding/color mappings/color lookup tables (LUTs)" determine how to translate an input set of colors to an output set of colors. Examples of such LUTs are fire LUTs, rainbow LUTs, hot iron LUTs, Hot/heated/black-body radiation color scale, . . . Sometimes there is a color management module (such as the ICC color management module (CMM)) that can take care of the appropriate transformation of the image in a particular color space, to raw color values (RGB; RGBW; . . . ) that can be visualized on a display device or system.

"Gamut" as used in this document is a set of realizable colors by an input/output device and takes a different shape in different color spaces. For example, a display's gamut can be a cube in its native RGB space ("the native gamut"), is then a diamond-like shape in CIELAB color space and is a parallelogram in CIEXYZ color space. A color space is a possible or ideal set of color points and the gamut refers to a representation of the actual reachable display color points in a certain color space. The display native gamut can be expressed in a certain color space (e.g. RGB, the display world), but this native gamut can also be expressed in CIELAB (the human vision world). In embodiments of the present invention a linearized display gamut expressed in a perceptually uniform space such as CIELAB is converted or transformed from the CIELAB to the display space such as RGB space.

"Geodesic" as used in this document refers to the incrementally shortest path between two points on a surface in terms of a certain distance metric.

"ICC profile". In color management, an ICC profile is a set of data that characterizes a color input or output device, or a color space, according to standards promulgated by the International Color Consortium (ICC). Profiles describe the color attributes of a particular device or viewing requirement by defining a mapping between the device source or target color space and a profile connection space (PCS). This PCS is either CIELAB (L*a*b*) or CIEXYZ. Mappings may be specified using tables, to which interpolation is applied, or through a series of parameters for transformations (http://en.wikipedia.org/wiki/ICC_profile). Since late 2010, the current version of the specification is 4.3.

Every device that captures or displays color can be profiled. Some manufacturers provide profiles for their products, and there are several products that allow an end-user to generate his or her own color profiles, typically through the use of a tri-stimulus colorimeter or preferably a spectrophotometer.

"Oversampled "means that the output (calibrated) color space is oversampled with respect to the input color space when the output color space can have a higher amount of color points. This is advantageous as it means that a calibrated color point can be selected which is close to any color point of the input space. As an example an input RGB space can have color points defined by a bit depth of 8 bits/color, which means that this space has $2^{24}$ colors. The output color space could also be an RGB space but with 10 bits/color, i.e. $2^{30}$ colors.

Description of the Illustrative Embodiments

The present invention is not limited to the described embodiments, but is limited only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated. The term "comprising", used in the claims, should not be interpreted as being restricted to the means listed thereafter; it does not exclude other elements or steps. Thus, the scope of the expression "a device comprising means A and B" should not be limited to devices consisting only of components A and B. It means that with respect to the present invention, the only relevant components of the device are A and B. Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein. Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

Methods according to embodiments of the present invention will be described with reference to FIGS. 1 to 16.

Calibration Transform Embodiments of the Present Invention

Embodiments of the present invention provide a method to produce a color calibration transform which can be stored in a non-volatile LUT memory, for example.

FIG. 1 shows a gamut, the set of realizable colors by a display device for example, in two color spaces which is assumed to be known. In color space 1, the gamut fills a volume, in this case a cube. This color space is an input color space for example a display native RGB color space. The cube has three axes, of red, green and blue color coordinates. This space is not a perceptually linear or uniform space. This color space could be selected for example because it is convenient when transferring images over a network. The same gamut is shown in color space 2, when transformed into a perceptually linear or uniform space such as CIELAB or CIELUV. The shape of the gamut is not the same in different color spaces. The distances between two color points in color space 2 is closer to their perceived difference. The present invention in embodiments includes a display model or measurements that express how the gamut is mapped from color space 1 (e.g., native RGB space) to color space 2 (e.g., CIELAB, a perceptually uniform space).

The next step is to populate the constant-hue lines that make up the outer edges of the gamut in color space 1 with color points having improved perceptional linearity, e.g. equidistant perceptually (e.g., equidistant in color space 2 or in terms of dE2000). With reference to the gamut in color space 1 these are straight lines but the present invention is not limited thereto. Once the color points having improved perceptional linearity, e.g. are equidistant, have been generated for a complete gamut in color space 2, the calibrated color space will be transformed into an output color space which is the color space of a display device. It is preferred if the display device (whose color response is defined in an output color space) has a larger number of potential color points than the input color space. This means that the output color space is oversampled with respect to the input color space. This is advantageous as it means that a calibrated color point can be selected which are very close to any color point of the input gamut.

In order to populate color points having improved perceptional linearity, e.g. equidistant in color space 2 along edges or diagonals of the gamut (color cube) of color space 1, a distance metric is calculated in color space 2 which is going to be the selected distance between color points. This metric can be any suitable color distance metric, for example any of deltaE76, deltaE94, deltaE2000. For gray points any suitable gray distance metric can be used, for example DICOM GSDF JND, or similar. For example for placing color points having improved perceptional linearity, e.g. equidistantly on diagonals or edges deltaE2000 can be selected which is defined by the formulae in FIG. 2. Note that deltaE2000 is not a Euclidean distance in CIELAB and that its predicted color difference is valid only when comparing nearby colors. Accordingly, the color distance metric such as deltaE2000 is calculated and used for the separation between successive (oversampled) points (d0 to d15) and these distances are then summed to the total length of the diagonal or edge. This is shown schematically in FIG. 3 where the total distance, D, is given by the sum: $D=\Sigma d_i$.

Figure 3:
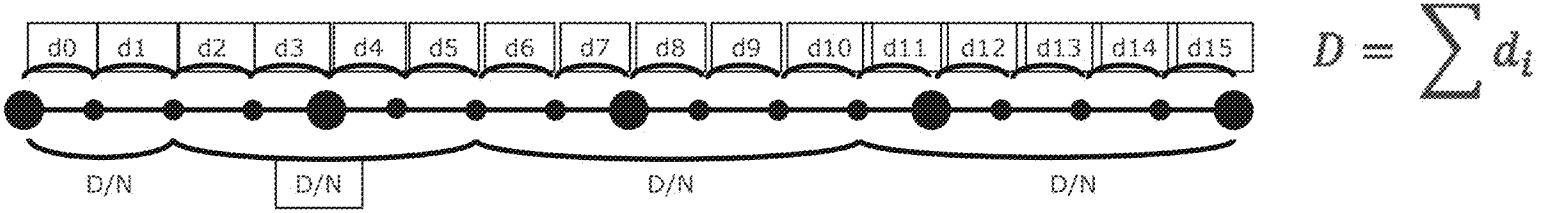
FIG. 3 illustrates application of deltaE200 color point spacing in an embodiment of the present invention.
Figure 5:
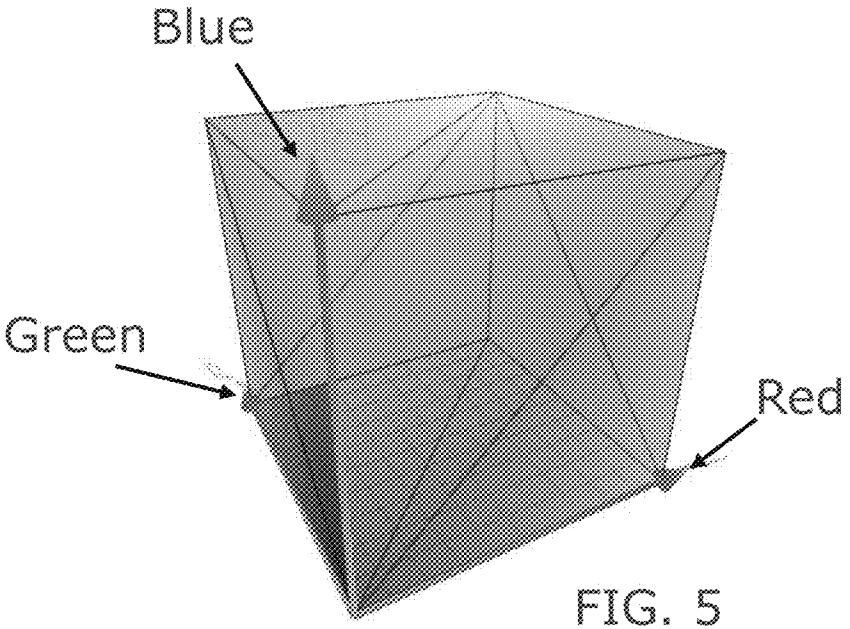
FIGS. 4 and 5 illustrate color points having improved perceptional linearity in a color space and being transformed back to another color space such that the color points are not equidistant in an embodiment of the present invention.

The new color points are selected from the oversampled set to have improved perceptional linearity, e.g. be perceptually equidistant. The variables of FIG. 3 are: $d_0$ to $d_{15}$ are the deltaE2000 distances between oversampled points along a color line D is the sum of $d_1$ to $d_{15}$ (i.e. the total length of the color line)

D/N is the total $\Delta E_{2000}$ length of the color line divided by the number of points we want on this line. FIG. 3 represents a color line in RGB space, while distances presented are expressed in CIELAB color space (deltaE2000). For example, if N+1 color points are desired on an edge of the gamut (e.g., N=255 when each color channel is expressed in 8 bits), the selected points are chosen to have a sum of $d_i$ and hence a distance of D/N in between them. Such placement of color points yields a one dimensional perceptual color uniformity. This procedure is carried out for all edges of the gamut (color cube) in color space 1, as well as one diagonal per face, i.e. the one going from lowest to highest luminance of the face; see FIG. 4.

Figure 4:
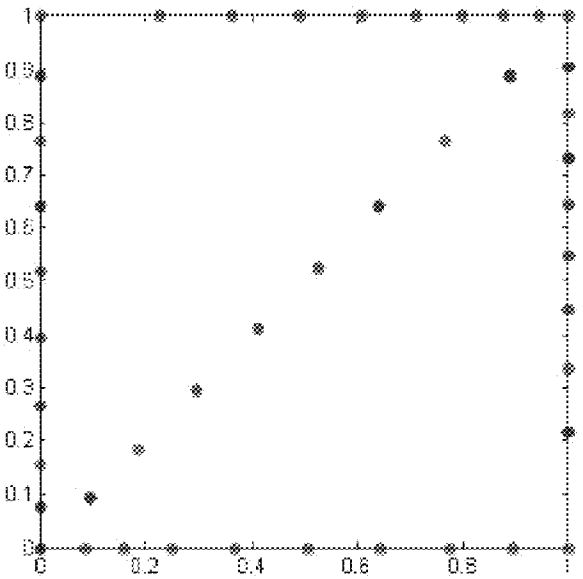

When the color points having improved perceptional linearity in color space 2, e.g. in a CIELUV, the CIE 1976 (Luv), the CIE 1976 (Lab) or the CIELAB color space 2, are transformed back to the input color space 1 (or to another output color space) such as an RGB color space the color points are not equidistant as shown in FIG. 4. However as the points have been calculated to have improved perceptional linearity, e.g. be equidistant in color space 2, these color points in color space 1 are perceptually linear.

The next step is to populate each of the side surfaces (i.e. faces) of the gamut volume (color cube) in color space 1. The points will be populated along deltaE2000 (or other color difference metric of choice) geodesics connecting the points on edges to the corresponding points on the diagonal of each face. A geodesic is the incrementally shortest path between two points on a surface in terms of a certain distance metric.

Straight lines in CIELAB, which are dE76 geodesics, may be used as computationally low-cost approximations of deltaE2000 geodesics. A straight line in the first color space 1 such as an RGB space is curved in the perceptually linear or uniform color space 2 e.g. CIELAB space as shown in FIG. 6 with color space 1 on the left and color space 2 on the right. On each line in color space 2 which can be e.g. as variously described as CIELUV, the CIE 1976 (Luv), the CIE 1976 (Lab) or the CIELAB color space, color points are distributed equidistantly using a color distance metric such as to define the distance between points on each line in perceptually linear or uniform space 2 such as deltaE76, deltaE94, deltaE2000, DICOM GSDF JND, in the L*a*b color space. The extremities of each line are defined in the first color space 1 such as the RGB space, then converted to the CIELab color space 2 or as named such as CIELUV, the CIE 1976 (Luv), the CIE 1976 (Lab) or the CIELAB color space. The method continues as before with providing more points in the color space 2 than in color space 1 (oversampling), computation of the distances from the distance metric and selection.

Figures 7A, 7B:
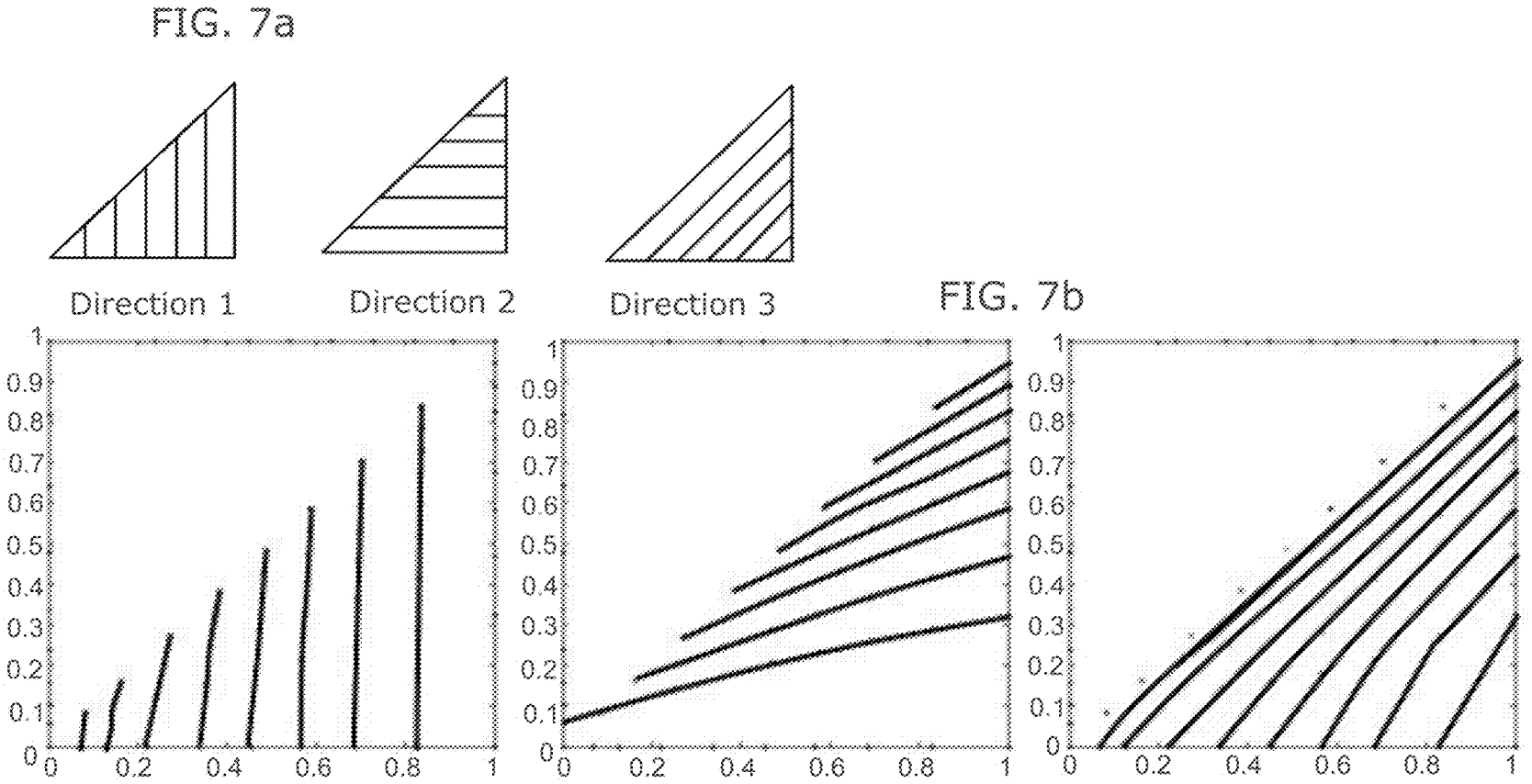
FIG. 7*a* shows lines of color points in the gamut cube and FIG. 7*b* shows how these lines are distorted when the color points are made equidistant in an embodiment of the present invention.

Considering half-faces of the gamut (color cube) of color space 1 as shown in FIG. 7*a* color points are distributed to have improved perceptional linearity, e.g. equidistantly along lines in 3 different directions 4,5,6 using the color distance metric such as DeltaE2000. The lines shown are (e.g. approximations of) the deltaE2000 geodesics on the gamut face that connect the equidistant set of points on the edges to the corresponding points on another edge or the face diagonal. The resulting points on the lines are converted back to color space 1 such as the RGB space as shown in FIG. 7*b*. The lines in 7*a* are points along color lines in three directions (1, 2 and 3) in color space A. In 7*a*, Direction 1, first line, the "x-axis" value will be constant for the whole line. After having converted to color space 2 and made some operation in this space (e.g. made it perceptually linear such as equidistant), the line is converted back to color space 1. Now the points of the Directions 1, first line have moved, their "x-value" is no longer constant along the line. The distance between lines in both 7*a* and 7*b* are distances between points along a line in a direction(1, 2 or 3) of color space 1.

Hence the color points are distributed between edges and diagonals of the gamut (color cube) of color space 1 such as the RGB space to create some triangles in those 3 directions 4, 5, 6) (e.g. Horizontal edge to diagonal, Vertical edge to diagonal, Horizontal edge to Vertical edge). Thus there will be three candidate positions P1, P2, P3, each resulting from one of the interpolations, which surround any point P on the half-face. Lines connecting P1, P2, P3 form a triangle 8 as shown in FIG. 8*a*. The point P, that makes up the perceptually uniform distribution on the face, is obtained from P1, P2, P3. For example, a weighted average can be used. The weighting may be based on the Euclidean distance between the edges of the triangle in the color space 1 such as the RGB space or lengths of the corresponding geodesics in color space 2; see FIG. 8*a*. For example the point P is located at a position defined by $$P = \frac{P_1 * d_{23} + P_2 * d_{13} + P_3 * d_{12}}{d_{23} + d_{13} + d_{12}}$$

Figure 8B:
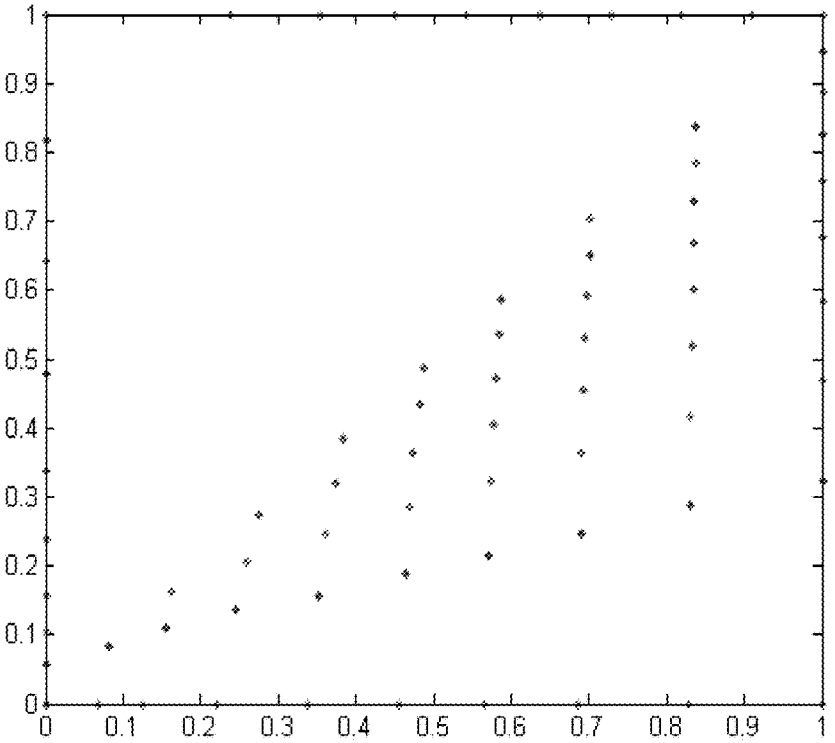
FIG. 8*a* and FIG. 8*b* shows how a color point is created on a face of the gamut cube in an embodiment of the present invention.
Figure 8C:
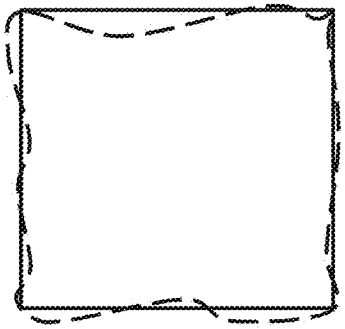
FIG. 8*c* indicates how manipulations of points in a perception linear color space can alter gamut boundaries when transformed to an input color space.
Figure 8A:
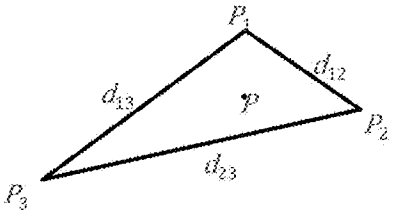

The result of this averaging process for a half-face is shown in FIG. 8*b* in color space 1 such as the RGB space (the lines are not straight in this color space) showing points similar to P which are the results of weighted averaging. The procedure is repeated for the other 11 half faces. The result is a number of weighted color points on all the faces of the color cube in color space 1 such as the RGB space. 2D surfaces of the RGB cube (color space 1) are converted to 3D surfaces in CIELAB color space (color space 2). What was a plane in RGB is now convex or concave in CIELAB. The transformation applied in CIELAB color space has an impact on the concavity of the surface of the gamut, and when the points are converted to the color space 1 the result in RGB is no longer a plane. The solution adopted is to keep only a projection of the result on the original plane. As lines in color space 2 are curved in color space 1, it is possible that the lines in color space 1 go outside the color cube or gamut of color space 1 as shown schematically in FIG. 8*c*. In order to avoid moving some color points of the gamut surface inside it, or outside, the points can be forced to remain on the faces of the cube.

Accordingly, the procedures described above ensure that points on gamut edges remain on their corresponding edge and points on gamut faces remain on their corresponding gamut face; thus ensuring that the shape of the gamut and in the example of a display device, its contrast and saturation, is fully preserved. There can be a need to force points to remain on the surface:

A Straight line in color space 2 such as L*a*b* is curved in color space 1 such as RGB. Points of the faces could have been pulled in or forced out of the gamut.

Hence force one channel per face to be 0 or 1.

Face (Black; Green; Blue; Cyan)→R=0

Face (Red; Yellow; Magenta; White)→R=1

Face (Black; Red; Blue; Magenta)→G=0

Face (Green; Yellow; Cyan; White)→G=1

Face (Black; Red; Green; Yellow)→B=0

Face (Blue; Magenta; Cyan; White)→B=1

Figure 9A:
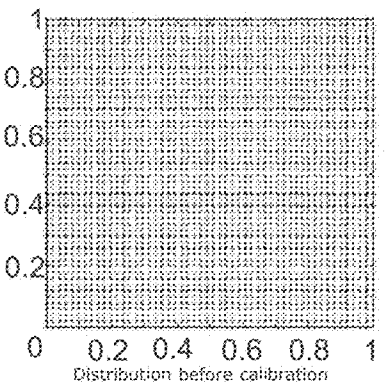
FIG. 9*a* shows regular distribution of color points on a gamut cube and FIG. 9*b* shows the distribution of color points on 6 faces of the cube in an embodiment of the present invention.
Figure 9B:
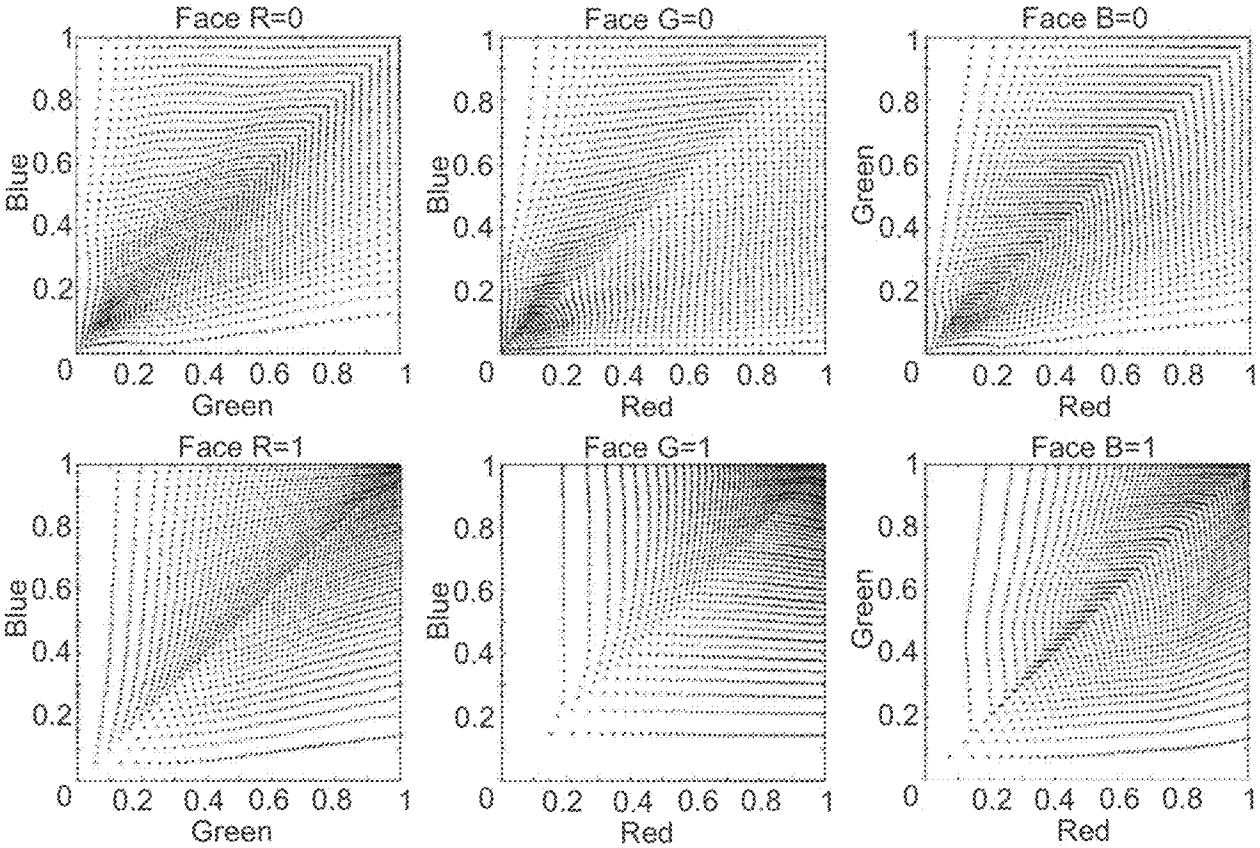
Figure 10:
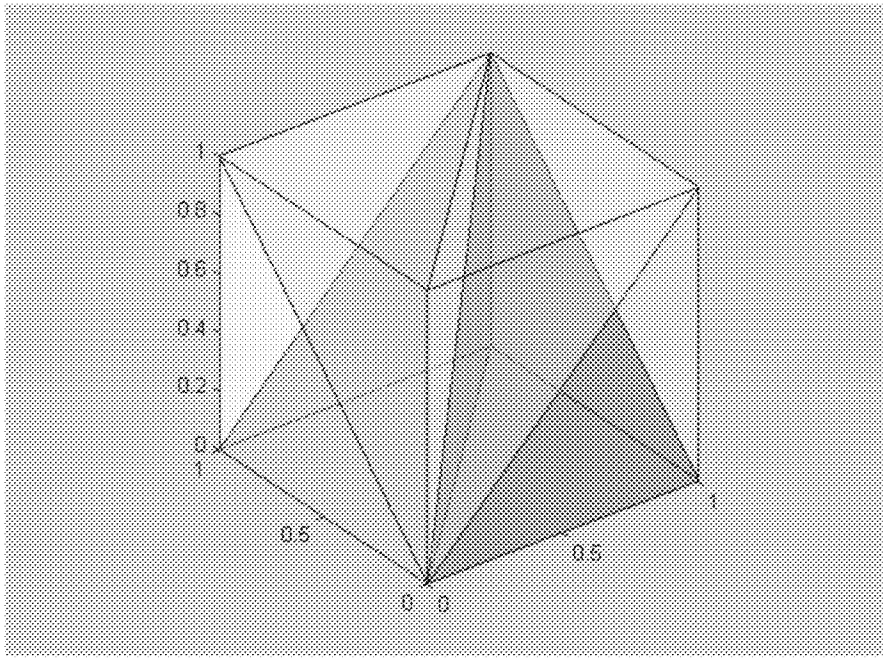
FIG. 10 indicates how tetrahedrons can be used as volume filling geometric structures in an embodiment of the present invention.

FIG. 9*a* shows the uniform grid on a gamut face in color space 1. FIG. 9*b* shows the point distribution on the six faces of the gamut in color space 1 according to the results of the procedures above. These points have now improved perceptional linearity, e.g. are perceptually equidistant.

The next step is to populate the space inside the gamut volume (color cube) of color space 1. Suitable color points can be obtained by interpolating between the faces and the gray line of the gamut. To do so a volume filling geometrical structure can be used, e.g. a tetrahedron which is polyhedron with a polygon base and triangular faces connecting the base to a common point. In the case of a tetrahedron, the base is also a triangle. The six tetrahedrons that partition and fill the gamut volume in color space 1 are shown schematically in FIG. 10. Note that the six tetrahedrons have the gray line in common and each is bounded by 2 faces of the gamut in color space 1, and 2 planes passing through the gray line and lie within the gamut The GSDF calibrated gray line (i.e., points on it are equidistant in terms of JND) is used as one edge of six triangles that lie within the gamut. Such triangles along with those on the faces of the gamut complete the envelopes of the six tetrahedrons. The color points in these tetrahedrons are remapped such that color differences between the neighboring points are as equal as possible throughout each tetrahedron, while keeping the transition between tetrahedrons smooth.

Inside the color cube or gamut there is no need to force the triangles to remain in a plane after calibration, unless strict hue preservation is required. A population method is preferably chosen to guarantee that the gray behavior is not (substantially) altered and that the gamut of the visualization system remains (almost) intact. The gray line can be DICOM GSDF compliant, follow some gamma or have any desired behavior.

The tetrahedrons have triangular sides and each triangle is treated like the half-face triangles as described with respect to FIGS. 7 and 8. This generates points on the surface triangles of the tetrahedral. An example method of distributing the points and filling the bodies of the tetrahedrons is given below and shown schematically in FIGS. 11 and 12.

Figure 11:
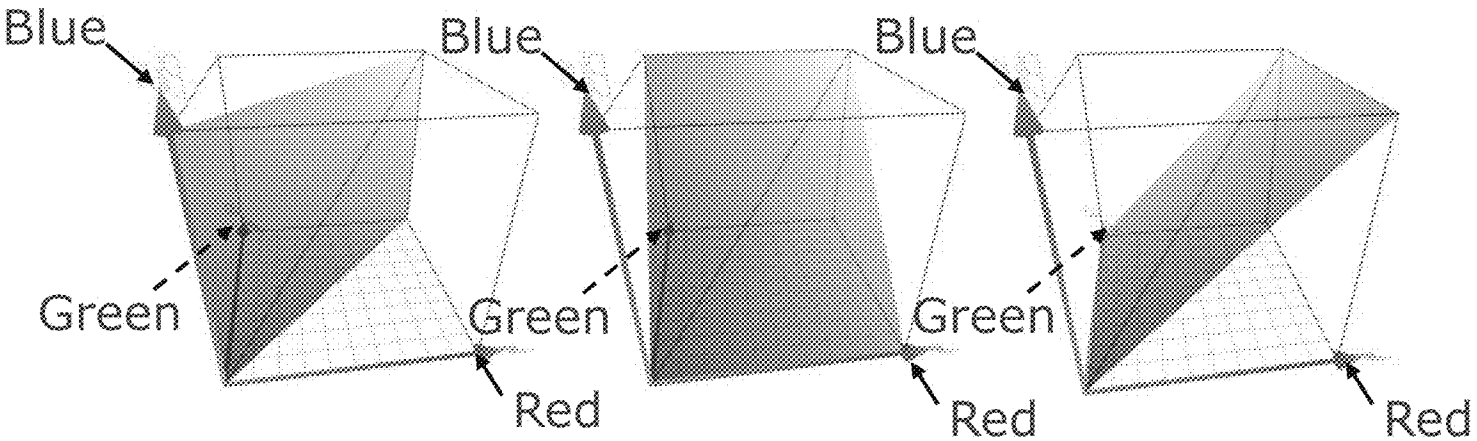
FIG. 11 and FIG. 12 indicates the manipulations with triangle faces of tetrahedrons to generate points within the tetrahedron in an embodiment of the present invention.
Figure 12:
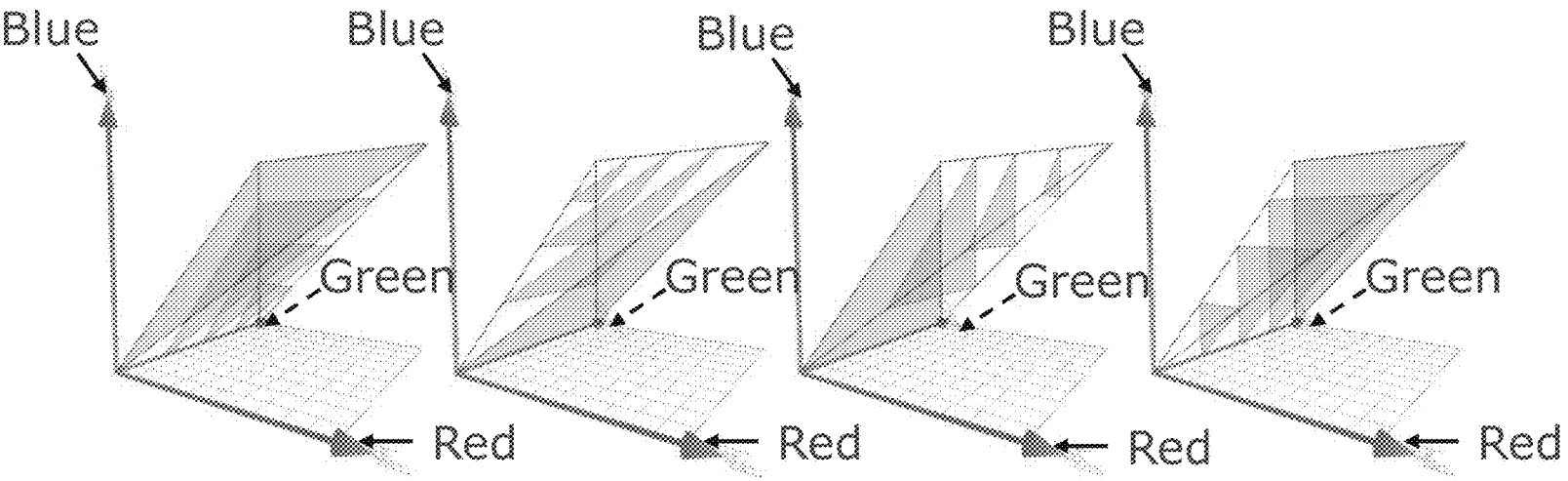
Figure 13:
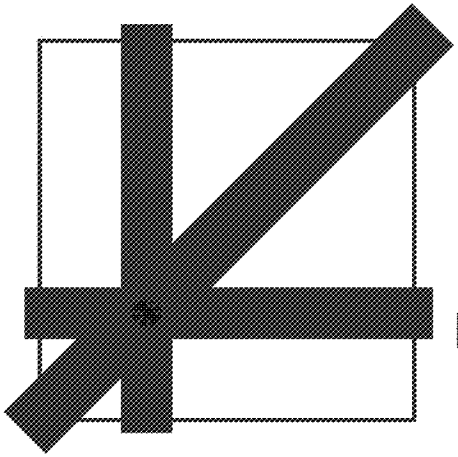
FIG. 13 illustrates blurring schematically in an embodiment of the present invention.

The points inside the tetrahedron are merged from four candidates generated as shown schematically in FIGS. 11 and 12 by interpolation and averaging. The description below gives an example of how the tetrahedrons are filled and also discloses that the determined points are recorded in a suitable memory format e.g. a non-volatile look up table (LUT) memory.

Filling Tetrahedrons with Equidistant Color Points

This is a description of a method that can be used to fill the tetrahedrons based on the points of their faces that have been defined previously.

Below is given the example of a tetrahedron Black-Red-Yellow-White

[(0, 0, 0)-(N−1, 0, 0)-(N−1, N−1, 0)-(N−1, N−1, N−1)]

N is the size of the 3D LUT

O is the origin (i.e. the Black point of the RGB cube).

$M_{RGB}$ is the point corresponding to input (R,G,B) (0, 0, 0) for Black, (N−1, N−1, N−1) for White.

$LUT_1$, $LUT_2$, $LUT_3$ and $LUT_4$ are temporary matrices used to store the results of the 4 for (i=1; i<N; ++i)

////////// Direction 1: triangles normal to axis Black to Red=>convergence to tip Black $tip_1$=(i,i,0) /* Changing from Black to Yellow with i */

$tip_2$=(i,0,0) /* Changing from Black to Red with i. */

$tip_3$=(i,i,i) /* Changing from Black to White with i. */

Fill Triangle [$tip_1$-$tip_2$-$tip_3$] with 2D methods used for faces.

Store [$tip_1$-$tip_2$-$tip_3$] in $LUT_1$

////////// Direction 2: triangles normal to axis Black to Blue=>convergence to tip White $tip_1$=(N−1,i,i) /* Changing from Red to White with i. */

$tip_2$=(i,i,i) /* Changing from Black to White with i. */

$tip_3$=(N−1,N−1,i) /* Changing from Yellow to White with i. */

Fill Triangle [$tip_1$-$tip_2$-$tip_3$] with 2D methods used for faces.

Store [$tip_1$-$tip_2$-$tip_3$] in $LUT_2$

////////// Direction 3: triangles normal to third direction=>convergence to tip Red $tip_1$=(N−1,N−i,0) /* Changing from Yellow to Red with i. */

$tip_2$=(i,0,0) /* Changing from Black to Red with i. */

$tip_3$=(N−1,N−i,N−i) /* Changing from White to Red with i. */

Fill Triangle [$tip_1$-$tip_2$-$tip_3$] with 2D methods used for faces.

Store [$tip_1$-$tip_2$-$tip_3$] in $LUT_3$

////////// Direction 4: triangles normal to Fourth direction=>convergence to tip Yellow $tip_1$=(N−1,i,0) /* Changing from Red to Yellow with i. */

$tip_2$=(i,i,0) /* Changing from Black to Yellow with i. */

$tip_3$=(N−1,N−1,N−i) /* Changing from White to Yellow with i. */

Fill Triangle [$tip_1$-$tip_2$-$tip_3$] with 2D methods used for faces.

Store [$tip_1$-$tip_2$-$tip_3$] in $LUT_4$

////////// The loop above handles only one tetrahedron, but it can easily manage the 6 in parallel, and store everything in $LUT_1$, $LUT_2$, $LUT_3$ and $LUT_4$.

for $(i = 0;\ i < N;\ ++i)$ for $(j = 0;\ j < N;\ ++j)$ for $(j = 0;\ k < N;\ ++k)$ $$LUT(i, j, k) = \frac{LUT_1(i, j, k) + LUT_2(i, j, k) + LUT_3(i, j, k) + LUT_4(i, j, k)}{4}$$

This last equation shows that each point inside the tetrahedron can be interpolated from four others by averaging.

Post Processing

The use of a color distance metric such as deltaE2000 to create color points having improved perceptional linearity, e.g. an equidistant distribution of points constrained by keeping the full gamut and GSDF gray are important features of the present invention. The interpolation techniques described above allow for smooth transition between color and gray behavior. While the interpolation techniques described above work better than known methods, it is only an example of a worked embodiment.

However, second-order discontinuities can still occur. In order to reduce the effect of discontinuities a blurring filter can be applied. For example, a 3D Gaussian blurring can be applied as shown schematically in FIG. 13. Such a filter can be a convolution filter with a quite a small edge kernel: for example a fifth or less of the LUT size. A Gaussian filter has the advantage of being separable, so the number of operations is proportional to the 1d-size of the LUT. The diameter of the filter is expressed in color points. A kernel of odd size can be selected to be symmetric around its central point: d=2r+1 The radius of the kernel is (rounded) for example one eleventh of the size of the LUT:

$$r = E\left(0.5 + \frac{n}{11}\right)$$

where n is the number of points per dimension of the 3D LUT (a 3D LUT of size n actually contains $n^3$ points). Then, the $i^{th}$ point of the kernel is defined as $$k_i = e^{\left(\frac{(i-r)^2}{2d}\right)}$$

Finally the kernel is normalized to make the sum of all the coefficients equal to one:

$$k_i = \frac{k_i}{\sum_j^d k_j}.$$

Other blurring filters can be used. The blurring filter will generally have an extent which is greater than the distance between two color points shown schematically in FIG. 14*a*. Management of the border effects is made to avoid moving the points of the surface within the LUT. Edges need not be filtered at all. However when the gray line is filtered, the DICOM calibration can be impaired. To avoid this, the gray points are returned to their correct positions to maintain DICOM GSDF for gray. To preserve the continuity of the colors, a blending is applied to color points in vicinity of gray on a plane orthogonal to gray. For each point of the diagonal, the blended area is defined as a 2D neighborhood in the plane orthogonal to the diagonal, and containing the considered gray levels. The area is the largest disk centered on gray that fits within the gamut in color space 1.

Figures 14A, 14B:
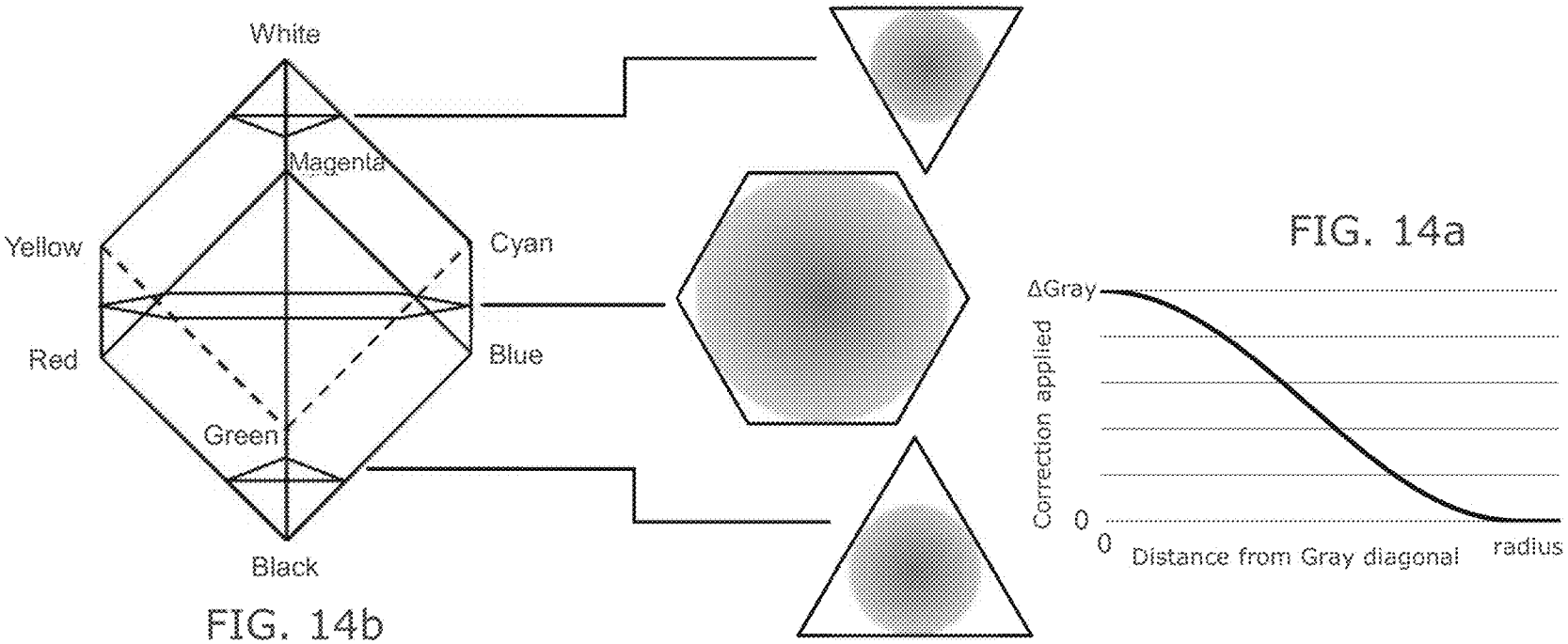
FIG. 14*a* indicates the spatial extent of a Gaussian smoothing filter in an embodiment of the present invention.
FIG. 14*b* shows cross sections of the color cube illustrating the correction applied as a function of the distance from the grey diagonal/the radius of the grey fields in an embodiment of the present invention.

The points into this area are partially moved with the gray, and the amount of their movement depends on the ratio 'distance to gray'/'radius of the disk'. The higher is the ratio (i.e., the more saturated the color), the smaller is the movement. FIG. 14B shows cross sections of the color cube rotated to be orthogonal to gray. There is a hexagon around the middle of the cube and triangles close to black and white. FIG. 14*b* shows the correction applied as a function of the distance from the grey diagonal/the radius of the grey fields inside the hexagon and triangles. The procedure to be used after the blurring to bring back the gray points to their correct position and preserve the smoothness of the calibration is described below.

Grayscale Correction and Blending

N is the size of the 3D LUT

O is the origin (i.e. the Black point of the RGB cube).

$G_i$ is the exact position of the $i^{th}$ gray point. /* Ordered from Black to White indexed from 0 to N−1 */

$G'_i$ is the actual position of the $i^{th}$ gray point after the blurring.

$\vec{V}_1$ is the vector $\overrightarrow{G'_1G_1}$.

for (R=0; R<N; ++R)

for (G=0; G<N; ++G)

for (B=0; B<N; ++B)

M is the point (R, G, B).

P is the projection of M on the Gray Diagonal.

op is the norm of vector $\overrightarrow{OP}$.

mp is the norm of vector $\overrightarrow{MP}$.

r is the radius of the largest disk centered on P, orthogonal to the Gray Diagonal and fitting into the RGB cube.

If (mp<r) /* If the points are within the disk defined by r */

$$a = E\left(\frac{op}{\sqrt{3}}\right) \Big/ * \; a \text{ is an interger.} \; * \Big/$$

If (a<N−1)

$$x = \frac{op}{\sqrt{3}} - a$$

$\vec{T}=\vec{V}_a+x*(\vec{V}_{a+1}-\vec{V}_a)$ /* In case P is not equal to one of the known points of the diagonal (the $G_i$), it has no vector $\vec{V}$ associated. In this case, we perform a linear interpolation in between the vectors corresponding to the last $G_i$ before P and the first one after. */ else $\vec{T}=\vec{V}_a$ $$M' = M + \vec{T} * \frac{\left(1 + \cos\left(\frac{mp}{r} * \pi\right)\right)}{2} \Big/ *$$

This is the function taking care of moving the point proportionally to their distance to the diagonal. A graph representing this function is given below */ else /* If the points are outside this disk, they are not moved at all */

M'=M

M' is the corrected point.

Figure 15:
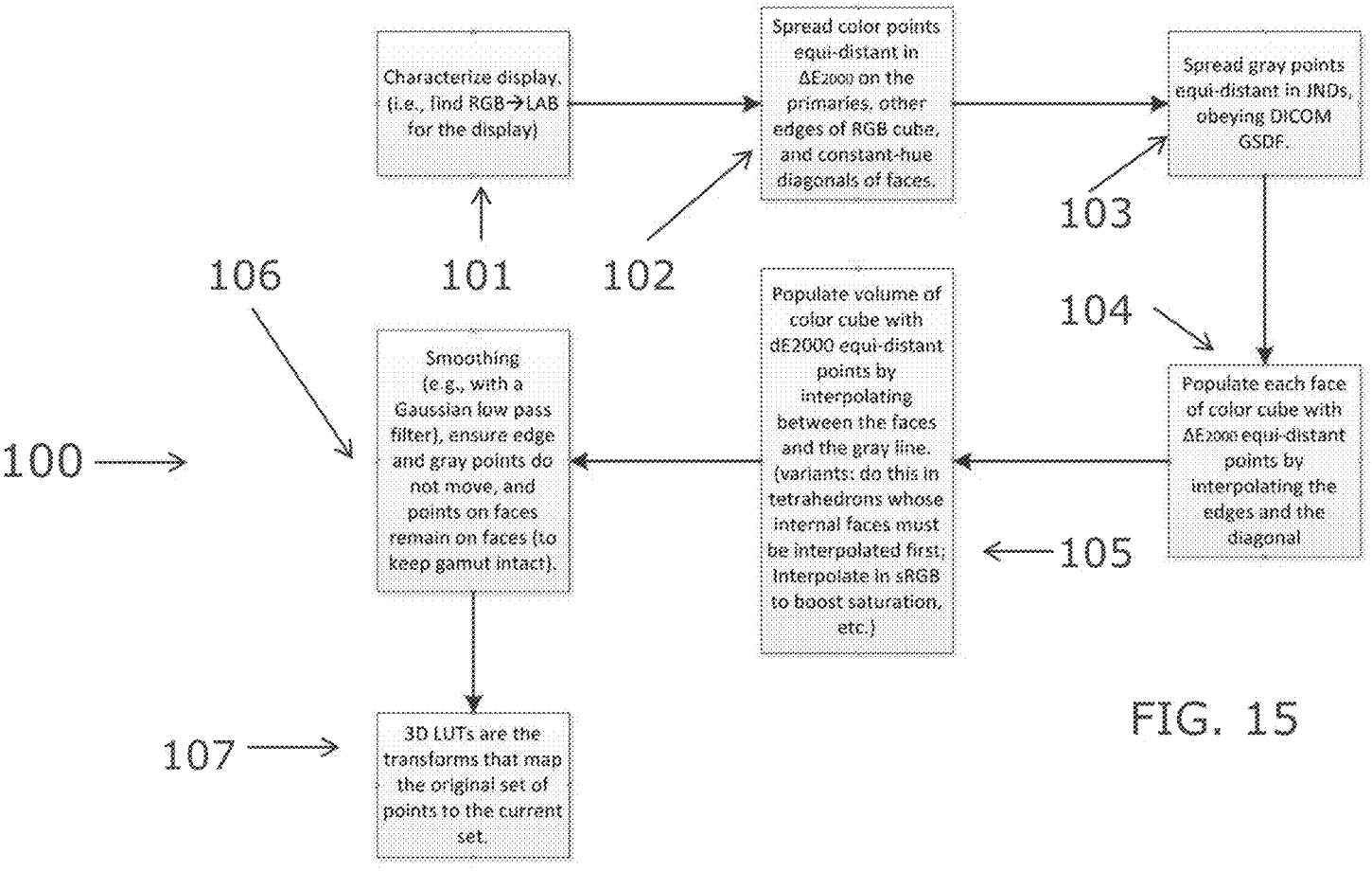
FIG. 15 illustrates a flow diagram of an embodiment of the present invention.

FIG. 15 is a flow chart of a calibration method 100 according to embodiments of the present invention. In step 101 a display device or system is characterized. This can involve measurements of the display device or system to determine the gamut of colors that can be displayed. An example of the gamut is a volume in a first color space such as the RGB color space. A transform is determined to transform any color point in the first color space to a second color space that is perceptually linear such as the CIELAB space. In step 102, color points on the primaries and other edges of the gamut volume in the first color space as well as constant hue diagonals of the gamut volume are spread to have improved perceptional linearity, e.g. equidistantly in a color distance metric such as deltaE2000. In step 102 gray points are spread to have improved perceptional linearity, e.g. equidistantly by means of a gray distance metric such as JND's. Preferably this is done obeying DICOM GSDF. In step 104 faces of the gamut volume in the first color space are populated with color points having improved perceptional linearity, e.g. equidistant points in a color distance metric such as deltaE2000. This is preferably done by interpolating from the edges and the diagonal of the gamut. In step 105 the volume of the gamut is populated with color points having improved perceptional linearity, e.g. equidistant points in a color distance metric such as deltaE2000 by interpolating between the faces of the gamut volume and the gray line. Optionally this can be done by constructing a set of volume filling geometrical figures such as a set of polyhydrons such as tetrahedrons. The internal faces of these figures are interpolated first. The interpolations may optionally made in the sRGB color space to boost saturation. In step 106 a smoothing filter can be applied. For example this could be a Gaussian low pass filter, e.g. a convolution filter. Gamut volume edge points and gray points are preferably forced not to move and points on the faces remain there. In this way the gamut volume is kept intact but some points are no longer spaced equidistantly. Despite this the set of calibrated color points as a whole still have improved perceptional linearity. Finally, in step 107, 3D LUT's are created and stored for example in a non-volatile memory of a display device, a controller for a display device or a display system. The 3D LUT provides the calibration transform that maps any point in the gamut volume in the first color space to a color point is a calibrated color space for use to display that color.

Embodiments of the Present Invention When the Display Gamut is Known

Based on the above and the description of FIGS. 1 to 15 a method and system according to an embodiment of the present invention can be summarized as follows. It comprises the following steps:

1. Working on edges and diagonals of the faces of gamut in color space 1, e.g. an RGB cube. This step can involve setting points having improved perceptional linearity, e.g. at equidistant steps of a color distance metric such as deltaE2000 on all edges of a color cube (e.g. primaries, secondaries and ternaries; 12 total), and setting points having improved perceptional linearity, e.g. at equidistant steps of a grayscale distance metric such as JND equidistant on gray.
2. Working on faces of the gamut in color space 1, e.g. RGB Cube. Next, the color points are determined within each triangle made from the edges and/or gray, including the triangles within the color cube that make up the boundaries of a volume filling plurality of geometric structures such as tetrahedrons. Each color point within the triangle is interpolated in 3 different ways and its final location (in calibrated space) is calculated by weighted averaging of the three locations.

3. Working Inside of the gamut volume in color space 1, e.g. RGB cube. The grayscale diagonal such as DICOM GSDF is maintained and the tetrahedrons faces are populated with color points. Inside the tetrahedrons is populated with color points.
4. For example, the triangle interpolation technique above is repeated within each triangle of the tetrahedron. Hence, each point within each tetrahedron is interpolated in 4 different ways and its final location (in calibrated space) is calculated by weighted averaging of the four locations.
5. Post processing.

Some more smoothing can be applied as a post processing.

Embodiments of the Present Invention when the Display Gamut is not Known

An embodiment of a system for visualizing medical color images or for use with a method according to embodiments of the present invention in a perceptual uniform color space can comprise the following components:

Internal color sensor

External color sensor

Visualization system with internal lookup tables and image processing modules whereby a method is provided to calculate lookup tables for the color calibration.

Based on the above description with respect to FIGS. 1 to 16, the following steps can be executed to obtain the optimized perceptual uniform color space.

The gamut of the visualization system is characterized using the internal and/or external color sensor. Depending on the required accuracy, more or less color points can be measured. The visualization system displays colors in N primary colors where N can be 3 for example (e.g. RGB) or 4 for example (CMYK) or more colors. Based on these measurements, N× 1D LUT e.g. 3× or 4× 1D LUT are determined that will be used to transform the gray diagonal of visualization system to conform to the desired behavior. The gray diagonal can be DICOM GSDF compliant or follow a gamma or any other transfer curve. In the following the invention will mainly be described with reference to a 3 primary color system but the present invention is not limited thereto.

Based on these measurements and taking into account the just defined 3× 1D LUT, a 3D LUT is determined that will transform the remainder of the gamut of the visualization system to a perceptual linear color space. The metric used to judge the perceptual uniformity is preferably a color distance. A suitable distance is, for example deltaE2000, deltaE76 or any other suitable color metric. The method to determine the 3D LUT is preferably chosen to guarantee that the behavior of the gray diagonal is not altered (or not altered substantially) and that the gamut of the visualization system is not reduced (or not reduced significantly). This can be obtained by making use of a geometric structure. For example by defining 6 different tetrahedrons, which have the gray diagonal in common and are bounded by 2 planes of the input color space cube, e.g. RGB color cube and 2 planes through the gray diagonal. The 6 tetrahedrons together form a volume equal to the complete volume of the input color space cube e.g. RGB cube. The color points in these tetrahedrons are remapped such that color differences between the neighboring points are as equal as possible throughout the tetrahedron, while keeping the transition between tetrahedrons smooth. This is done by limiting the spreading of the points in 1D (edges of the tetrahedrons) then in 2D (faces of the tetrahedrons) and finally in 3D (triangles inside the tetrahedrons).

The determined 3× 1D and 3D LUT are loaded in the internal lookup tables of the visualization system. From this moment onwards the visualization system has a perceptually uniform color space and is optimized for viewing medical color images.

As an additional useful option, the system or method can be adapted so that the internal and/or external color sensor checks the perceptual uniformity of the color space of the visualization system on a regular and optionally automatic basis. When due to the changes of the visualization system it is not any longer perceptually uniform, the procedure described above can be repeated to maintain the perceptually uniformity of the system.

Figure 16:
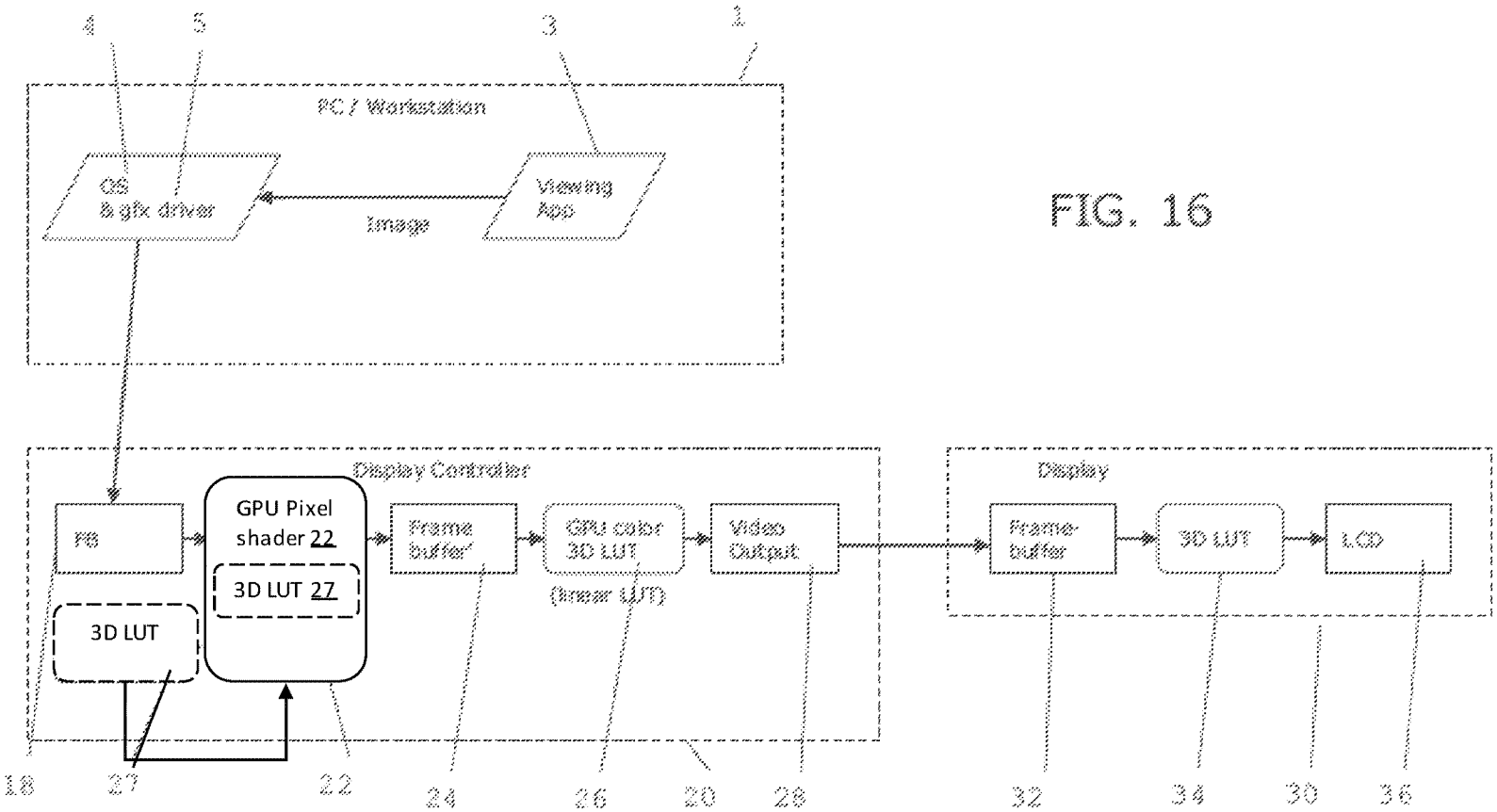
FIG. 16 shows a display system in accordance with an embodiment of the present invention.

Embodiments of the Present Invention Where the Calibration Transform is Integrated into a Display Device or Display System FIG. 16 shows a processing device 1 such as a personal computer (PC), a workstation, a tablet, a laptop, a PDA, a smartphone etc., a display controller 20 and a display 30. The processing device has a processor such as a microprocessor or an FPGA and memory such as RAM and/or non-volatile memory. The processing device 1 can be provided with an operating system 4 and a graphics driver 5. An application such as a viewing application 3 can run on the processing device 1 and can provide an image to the display controller 20 under the control of the operating system 4 and the driver 5 for display on the display device 30. The display device 30 can be any device which creates an image from image data such as a direct view screen, a rear projection screen, a computer screen, a projector screen or a printer. As shown in FIG. 16 for convenience and clarity the display device 30 displays the mage on display pixels 36 such as a screen (e.g. a fixed format display such as an LCD, OLED, plasma etc.) or projector and screen. Images may be input into the processing device 1 from any suitable input device such as from computer peripheral devices such as optical disks (CDROM, DVD-ROM, solid state memories, magnetic tapes, etc.) or via network communications interfaces (RS232, ETHERNET etc.) or bus interfaces such as IEEE-488-GPM, ISA and EISA. Images may also be generated in processing device 1.

A modern display system comprises a display controller 20 such as medical display controller, e.g. provided with a programmable pipeline. A part of this programmable hardware pipeline can include an array of SIMD processors that are capable of executing short software programs in parallel. These programs are called "pixel shaders", "fragment shaders", or "kernels", and take pixels as an input, and generate new pixels as an output. The image is stored in a frame buffer 18 in the display controller 20. A pixel shader 22 of display controller 20 processes the image and provides the new image to a further frame buffer 24. The new image is then provided with colour information from a colour Look-up-Table (non-volatile LUT memory) 26 (which can be in accordance with any of the embodiments of the present invention) and provided as a video output 28. The video output is stored in a frame buffer 32 of the display, optionally the image data further can be modified if necessary from a Look-up-Table (non-volatile LUT memory) 34 (which can be in accordance with any of the embodiments of the present invention) the display before being supplied to the pixels 36 of the display 30.

In the present invention the color values of the input signal such as the RGB color components can be used to do a lookup in a 3D non-volatile LUT memory which can be in accordance with any of the embodiments of the present invention. Such a 3D non-volatile LUT memory in accordance with any of the embodiments of the present invention can be implemented in a display (e.g. in or as non-volatile LUT memory 34). In this case the display non-volatile LUT memory 34 does not consist of three independent non-volatile LUT memories (one for each colour channel), but it is a 3D non-volatile LUT memory where color points of an output color space such as RGB output triplets are stored for each (or a subset of) color points of an input color space such as RGB input triplets. In accordance with embodiments of the present invention Look-up-Table (non-volatile LUT memory) 34 can be the main or only non-volatile LUT memory which stores the calibration transform of any of the embodiments of the present invention. Alternatively the lookup in a 3D non-volatile LUT memory can also be integrated to the display controller 20, for example in a 3D non-volatile LUT memory 26 in accordance with any of the embodiments of the present invention. In accordance with embodiments of the present invention Look-up-Table (non-volatile LUT memory) 26 can be the main or only non-volatile LUT memory which stores the calibration transform of any of the embodiments of the present invention.

Alternatively, this 3D non-volatile LUT memory functionality can also be implemented as a post-processing texture non-volatile LUT memory in accordance with any of the embodiments of the present invention in a GPU, e.g. provided in display controller 20. For example, a 3D non-volatile LUT memory 27 in accordance with any of the embodiments of the present invention can be added as input to the Pixel shader 22. For example, a 3D non-volatile LUT memory 26 in accordance with any of the embodiments of the present invention can be the main or only non-volatile LUT memory which stores the calibration transform of any of the embodiments of the present invention. In accordance with the present invention a non-volatile LUT memory such as LUT 26, 27 or 34 n accordance with any embodiment will be oversampled. For example the bit depth of the color points in the input color space can be less than the bit depth of the color points in the output space. Thus more colors can be reached in the output space compared with the input space while both can be RGB color spaces for example. However, it is included within the scope of the invention that optionally downsampling of the non-volatile LUT memory such as LUT 26, 27 or 34 can be applied to reduce the number of entries. In that case interpolation may be necessary to create color points in an output color space such an RGB output triplets corresponding to any arbitrary color points of an input color space such as RGB input triplets for which no output value was stored in the 3D non-volatile LUT memory such as LUT 26, 27 or 34. Any or all of these LUT's 26, 27 or 34 can be provided as a pluggable memory item. The display device 30 or the display system has means for inputting a color point of the native gamut to the non-volatile 3D LUT memory 26, 27 or 34 and for outputting a calibrated color point in accordance with the color transform. The non-volatile 3D LUT memory 26, 27 or 34 stores color points equidistant in three dimensions. The color points stored in the non-volatile 3D LUT memory are spaced by a color distance metric. The color points stored in the non-volatile 3D LUT memory can be spaced by a first distance metric in a first part of a color space, and a second distance metric in another part of the color space.

Implementation

Methods according to embodiments of the present invention and systems according to the present invention for generating a calibration transform can be implemented on a computer system that is specially adapted to implement methods of the present invention. The computer system includes a computer with a processor and memory and preferably a display. The memory stores machine-readable instructions (software) which, when executed by the processor cause the processor to perform the described methods. The computer may include a video display terminal a data input means such as a keyboard, and a graphic user interface indicating means such as a mouse or a touch screen. tation or a personal computer or a laptop.

The computer typically includes a Central Processing Unit ("CPU"), such as a conventional microprocessor of which a Pentium processor supplied by Intel Corp. USA is only an example, and a number of other units interconnected via bus system. The bus system may be any suitable bus system. The computer includes at least one memory. Memory may include any of a variety of data storage devices known to the skilled person such as random-access memory ("RAM"), read-only memory ("ROM"), and non-volatile read/write memory such as a hard disc as known to the skilled person. For example, the computer may further include random-access memory ("RAM"), read-only memory ("ROM"), as well as a display adapter for connecting the system bus to a video display terminal, and an optional input/output (I/O) adapter for connecting peripheral devices (e.g., disk and tape drives) to the system bus. The video display terminal can be the visual output of computer, and can be any suitable display device such as a CRT-based video display well-known in the art of computer hardware. However, with a desk-top computer, a portable or a notebook-based computer, the video display terminal can be replaced with a LCD-based or a gas plasma-based flat panel display. The computer further includes an user interface adapter for connecting a keyboard, mouse, and optional speaker.

The computer can also include a graphical user interface that resides within machine-readable media to direct the operation of the computer. Any suitable machine-readable media may retain the graphical user interface, such as a random access memory (RAM), a read-only memory (ROM), a magnetic diskette, magnetic tape, or optical disk (the last three being located in disk and tape drives). Any suitable operating system and associated graphical user interface (e.g., Microsoft Windows, Linux) may direct CPU. In addition, computer includes a control program that resides within computer memory storage. Control program contains instructions that when executed on CPU allow the computer to carry out the operations described with respect to any of the methods of the present invention.

Those skilled in the art will appreciate that other peripheral devices such as optical disk media, audio adapters, or chip programming devices, such as PAL or EPROM programming devices well-known in the art of computer hardware, and the like may be utilized in addition to or in place of the hardware already described.

The computer program product for carrying out the method of the present invention can reside in any suitable memory and the present invention applies equally regardless of the particular type of signal bearing media used to actually store the computer program product. Examples of computer readable signal bearing media include: recordable type media such as floppy disks and CD ROMs, solid state memories, tape storage devices, magnetic disks.

The software may include code which when executed on a processing engine causes a color calibration method for use with a display device to be executed. The software may include code which when executed on a processing engine causes expression of a set of color points defining a color gamut in a first color space. The software may include code which when executed on a processing engine causes mapping of said set of color points from the first color space to a second color space. The software may include code which when executed on a processing engine causes redistributing the mapped set of points in the second color space wherein the redistributed set has improved perceptional linearity while substantially preserving the color gamut of the set of points. The software may include code which when executed on a processing engine causes mapping the redistributed set of points from the second color space to a third color space. and storing the mapped linearized set of points in the non-volatile memory for the display device as a calibration transform.

The software may include code which when executed on a processing engine causes redistributing the mapped set of points in the second color space by linearizing the mapped set of points in the second color space by making the color points in the second color space equidistant throughout the color space. The third color space is the same as the first color space. The software may include code which when executed on a processing engine allows receipt of measurements of the set of color points in the first color space.

The software may include code which when executed on a processing engine causes the improved perceptional linearity to be obtained by:

Partitioning the color gamut in the first color space using polyhedrons such as tetrahedrons;

Redistributing the set of color points on the edges of each polyhedron to obtain improved perceptual linearity on the edges of each polyhedron;

Redistributing the set of color points on the faces of each polyhedron to obtain improved perceptual linearity on the faces by replacing each such color point by an interpolated value obtained based on the redistributed color points surrounding points on edges of the polyhedron that form the boundaries of that face of the polyhedron;

Redistributing the set of color points inside each polyhedron to obtain improved perceptual linearity by replacing each such color point by an interpolated value obtained based on the redistributed points surrounding faces of the polyhedron containing the inside color point.

The software may include code which when executed on a processing engine causes the improved perceptional linearity to be obtained by:

Partitioning the color gamut in the first color space using polyhedrons such as tetrahedrons;

Redistributing the set of color points on the edges of each polyhedron to obtain improved perceptual linearity on the edges of each polyhedron;

Redistributing the set of color points on the faces of each polyhedron to obtain improved linearity of the Euclidean distances between color points on the faces by replacing each such color point by an interpolated value obtained based on the redistributed points surrounding points on edges of the polyhedron that form the boundaries of that face of the polyhedron;

Redistributing the set of color points inside each polyhedron to obtain improved linearity of the Euclidean distances between color points inside each polyhedron by replacing each such color point by an interpolated value obtained based on the redistributed surrounding faces of the polyhedron containing the inside color point.

The software may include code which when executed on a processing engine causes the color point linearizing procedure to make color points that are spaced by a color distance metric of equidistance in the second color space.

The software may include code which when executed on a processing engine causes a first distance metric to be used in a first part of the second color space, and a second distance metric to be used in another part of the second color space. The second part of the second color space can primarily contain the neutral grey part of the second color space and the first part of the second color space can primarily exclude the neutral grey part of the second color space.

The software may include code which when executed on a processing engine causes he point linearizing procedure to comprise setting gray points in the second color space equidistant in terms of a second distance metric.

The software may include code which when executed on a processing engine causes DICOM GSDF compliance for gray to be ensured The software may include code which when executed on a processing engine causes applying of a smoothing filter to reduce discontinuities in the border areas between the first part of the second color space and the second part of the second color space.

The software may be stored on a suitable non-transitory signal storage means such as optical disk media, solid state memory devices, magnetic disks or tapes or similar.

What is claimed is:

1. A display device having a native gamut defined in a first color space, the display device comprising:

a non-volatile memory storing a calibration transform configured to linearize a color space, wherein:

the calibration transform has a set of calibrated color points derived from color points of the native gamut; and the set of calibrated color points has improved perceptional linearity compared with the native gamut while preserving the color gamut: and a processor configured to:

receive an image defined In a first colors space to be displayed on the display device;

receive the calibration transform from the memory:

apply the received calibration transform to the received image to generate a calibrated image, such that:

a color space of the calibrated image is linearized:

the color space of the calibrated image has improved perceptional linearity compared to the native gamut; and the color gamut of the received image is preserved in the calibrated image; and cause the calibrated image to be displayed.

2. The display device of claim 1, wherein the calibration transform is stored in a non-volatile 3D LUT (lookup table) memory.

3. The display device of claim 2, further comprising a graphical user interface for inputting a color point of the native gamut to the non-volatile 3D LUT memory and for outputting a calibrated color point in accordance with the color transform.

4. The display device of claim 2, wherein the non-volatile 3D LUT memory stores color points equidistant in three dimensions.

5. The display device of claim 4, wherein the color points stored in the non-volatile 3D LUT memory are spaced by a color distance metric.

6. The display device of claim 5, wherein the color points stored in the non-volatile 3D LUT memory are spaced by a first distance metric in a first part of a color space, and a second distance metric in another part of the color space.

7. The display device of claim 6, wherein a second part of the color space primarily contains a neutral grey part of the color space and where the first part of the color space primarily excludes the neutral grey part of the color space.

8. The display device of claim 6, further comprising a border area between the first part of the color space and a second part of the color space, the border area being smoothed with reduced discontinuities.

9. The display device of claim 5, wherein the color points are equidistant in terms of the color distance metric.

10. The display device of claim 5, wherein gray points in the color space are equidistant in terms of a second distance metric.

11. The display device of claim 2, wherein the non-volatile 3D LUT memory is in a display controller.

12. The display device of claim 2, wherein the non-volatile 3D LUT memory is associated with a GPU.

13. The display device of claim 2, wherein the non-volatile 3D LUT memory is in a display controller.

14. The display device of claim 2, wherein the non-volatile 3D LUT memory is in a pixel shader.

15. The display device of claim 1, wherein the calibration transform conforms to a DICOM (Digital Imaging and Communications in Medicine) standard.

* * * * *